US009366981B2

(12) United States Patent
Yamawaki et al.

(10) Patent No.: US 9,366,981 B2
(45) Date of Patent: Jun. 14, 2016

(54) TONER AND TONER PRODUCTION METHOD

(71) Applicant: CANON KABUSHIKI KAISHA, Tokyo (JP)

(72) Inventors: Kentaro Yamawaki, Mishima (JP); Takeshi Tsujino, Mishima (JP); Hidekazu Fumita, Gotemba (JP); Nobuhisa Abe, Susono (JP); Junya Asaoka, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/314,015

(22) Filed: Jun. 24, 2014

(65) Prior Publication Data

US 2015/0004535 A1 Jan. 1, 2015

(30) Foreign Application Priority Data

| | | |
|---|---|---|
| Jun. 27, 2013 | (JP) | 2013-135170 |
| Jun. 4, 2014 | (EP) | 14171069 |
| Jun. 19, 2014 | (JP) | 2014-126156 |

(51) Int. Cl.
*G03G 9/08* (2006.01)
*G03G 9/087* (2006.01)

(52) U.S. Cl.
CPC ..... *G03G 9/081* (2013.01); *G03G 9/0821* (2013.01); *G03G 9/08711* (2013.01); *G03G 9/08782* (2013.01); *G03G 9/08797* (2013.01)

(58) Field of Classification Search
CPC ..... G03G 9/08782; G03G 9/0821
USPC ..... 430/108.8, 111.4
See application file for complete search history.

(56) References Cited

U.S. PATENT DOCUMENTS

| | | | |
|---|---|---|---|
| 8,545,133 | B2 | 10/2013 | Fumita et al. |
| 8,822,120 | B2 | 9/2014 | Abe et al. |
| 2005/0272851 | A1 | 12/2005 | Agur et al. |
| 2006/0204880 | A1 | 9/2006 | Mizutani et al. |
| 2007/0026335 | A1 | 2/2007 | Yamamoto et al. |
| 2011/0294063 | A1 | 12/2011 | Yuge et al. |

FOREIGN PATENT DOCUMENTS

| | | | |
|---|---|---|---|
| EP | 2 410 381 | A1 | 1/2012 |
| JP | 2011-70001 | A | 4/2011 |
| JP | 2012-13859 | A | 1/2012 |
| WO | 2012/046584 | A1 | 4/2012 |

OTHER PUBLICATIONS

Fedors, "A Method for Estimating Both the Solubility Parameters and Molar Volumes of Liquids", Polymer Engineering and Science, Feb. 1974, vol. 14, No. 2.

European Search Report dated Nov. 27, 2014 in European Application No. 14171069.9.

Mukai, "Gijutsusha no tame no Jitsugaku Kobunshi" (Practical polymer science for scientists and engineers), 1981, pp. 66-73.

Grulke, "Solubility Parameters Values", Polymer Handbook, Fourth Edition, 2003, pp. VII 675-VII 683.

*Primary Examiner* — Mark A Chapman
(74) *Attorney, Agent, or Firm* — Fitzpatrick, Cella, Harper and Scinto

(57) ABSTRACT

A toner which includes a binder resin, a colorant and a hydrocarbon wax has a ratio W1/W2 of the half width W1 (° C.) of a endothermic peak derived from melting of the hydrocarbon wax in a first temperature rise process on the toner to the half width W2 (° C.) of a endothermic peak derived from melting of the hydrocarbon wax in a second temperature rise process, as measured with a differential scanning calorimeter, with the ratio W1/W2 being not less than 0.50 and not more than 0.90.

13 Claims, No Drawings

TONER AND TONER PRODUCTION METHOD

BACKGROUND OF THE INVENTION

1. Field of the Invention

The present invention relates to an electrostatic latent image-developing toner (referred to below simply as a "toner") for use in developing electrostatic latent images (electrostatic images) in, for example, electrophotographic, electrostatic recording and electrostatic printing processes. The invention also relates to a method of producing such a toner. More specifically, the invention relates to a toner which achieves a good balance of low-temperature fixability and heat-resistant storability and also provides an excellent fixed image reliability, and to a method of producing such a toner.

2. Description of the Related Art

Methods of visualizing image information via an electrostatic latent image, such as electrophotography, are currently employed in various fields, and there exists a desire for improvements in performance, including higher image quality and lower energy consumption. In electrophotography, first an electrostatic latent image is formed on an electrophotographic photoreceptor (image-bearing member) by way of charging and light exposure steps. The electrostatic latent image is then developed with a toner-containing developer, thereby giving a visualized image (fixed image) via a transfer step and a fixing step.

In this process, the fixing step is a step that requires a relatively large amount of energy, and so developing a system and materials which achieve both lower energy consumption and higher image quality has been an important technical challenge. One approach that can be taken from the materials aspect is to both enhance the releasability of the toner from the fixing member by including wax in the toner, and also increase the low-temperature fixability by plasticizing the binder resin with wax that has melted during fixing.

From the standpoint of enhancing the low-temperature fixability with wax, it is preferable to use a low-melting wax. On the other hand, because low-melting waxes melt at low temperatures, the heat-resistant storability of the toner is lost, making it difficult to achieve both low-temperature fixability and heat-resistant storability.

Art is known which, by using wax having a narrow melting temperature range, allows the wax to rapidly melt at the temperature at which fixing is carried out without melting when the toner is stored. Japanese Patent Application Laid-open No. 2012-13859 discloses art which uses a wax having, as measured with a differential scanning calorimeter in a toner, half width of an endothermic peak of 8° C. or less.

However, from the standpoint of the rubbing resistance of the fixed image and image non-uniformity, using a wax having a narrow melting temperature width is disadvantageous. Japanese Patent Application Laid-open No. 2011-70001 discloses art which uses a wax having a somewhat broad half width; specifically, the half width of the endothermic peak for a release agent, as determined with a differential scanning calorimeter, is not less than 10° C. and not more than 18° C.

SUMMARY OF THE INVENTION

Waxes for which, as in Japanese Patent Application Laid-open No. 2012-13859, the half width of the endothermic peak, as determined with a differential scanning calorimeter (DSC), is narrow have a narrow wax melting temperature range. Accordingly, melting of the wax at the toner storage temperature is prevented and the wax can be made to rapidly melt at a desired temperature, which is advantageous from the standpoint of enhancing low-temperature fixability while ensuring heat-resistant storability. Yet, such waxes are undesirable in terms of image reliability, such as the rubbing resistance of the fixed image. The reason is that, when a low-melting wax is used, the wax bleeds rapidly from the toner, coating the image surface. This improves the slip properties at the image surface but the strength of the fixed image decreases. On the other hand, when a high-melting wax is used, the high-melting wax remains at the interior of the fixed image and so the fixed image has an improved strength. However, the dearth of ingredients for coating the image surface appears to give rise to poor slip properties at the image surface.

Waxes for which, as in Japanese Patent Application Laid-open No. 2011-70001, the half width of the endothermic peak as determined by DSC is broad have a broad melting temperature range. Therefore, the existence of waxes having low-melting components which coat the image surface and waxes having high-melting components which remain at the interior of the fixed image and ensure image strength is advantageous from the standpoint of the reliability of the fixed image, such as the rubbing resistance of the fixed image. Yet, because the melting temperature range is broad, when trying to ensure heat-resistant storability, the wax melting point must be raised, which is disadvantageous from the standpoint of achieving a good balance between the low-temperature fixability and the heat-resistant storability.

It is thus apparent that, from the standpoint of achieving a good balance between the heat-resistant storability and the low-temperature fixability, a wax having an endothermic peak with a small half width should be used and, from the standpoint of improving the reliability of the fixed image, a wax for which this half width is somewhat large should be used. However, because each of these interferes with the desirable effects of the other, art that combines such waxes in a blend or the like has been difficult to achieve.

As noted above, in the existing art, it has been difficult to achieve an improved reliability of the fixed image while maintaining a good balance between low-temperature fixability and heat-resistant storability through control of the wax melting properties.

It is thus an object of this invention to provide a toner which strikes a good balance between low-temperature fixability and heat-resistant storability, and also has a fixed image reliability that is excellent. Another object of the invention is to provide a method of producing such a toner.

Accordingly, in a first aspect, the invention provides a toner which comprises a binder resin, a colorant and a hydrocarbon wax, and is characterized in that the toner has a ratio W1/W2 of the half width W1 (° C.) of a endothermic peak derived from melting of the hydrocarbon wax in a first temperature rise process on the toner to the half width W2 (° C.) of a endothermic peak derived from melting of the hydrocarbon wax in a second temperature rise process on the toner, as measured with a differential scanning calorimeter, which is not less than 0.50 and not more than 0.90.

In a second aspect, the invention provides a method of producing the toner comprising a binder resin, a colorant and a hydrocarbon wax, this method comprising: heat-treating the toner under following conditions of a step (a) and a step (b), with the step (a) being implemented before the step (b), (a) heat-treating the toner for not less than 60 minutes at a temperature not less than 10° C. higher than the extrapolated melting end temperature of the hydrocarbon wax, as measured with a differential scanning calorimeter in the presence of the binder resin and the hydrocarbon wax; and (b) heat-treating the toner for not less than 60 minutes at a temperature within the temperature range of the exothermic peak derived from crystallization of the hydrocarbon wax as measured with a differential scanning calorimeter, with a temperature fluctuation range that is centered on a temperature below the extrapolated melting onset temperature of the hydrocarbon wax being not more than 4.0° C.

This invention is able to provide a toner which, owing to suitable control of the wax melting properties, achieves a good balance of low-temperature fixability and heat-resistant storability and also has an excellent fixed image reliability, and is able to provide as well a method of producing such a toner.

Further features of the present invention will become apparent from the following description of exemplary embodiments.

BRIEF DESCRIPTION OF THE EMBODIMENTS

In order to overcome the above problems, the inventors have conducted extensive investigations on wax melting properties. As explained above, from the standpoint of achieving a good balance between the heat-resistant storability and the low-temperature fixability, use should be made a wax having an endothermic peak with a small half width, whereas from the standpoint of enhancing the reliability of the fixed image, use should be made of a wax having an endothermic peak with a somewhat large half width. Here, a good balance of heat-resistant storability and low-temperature fixability is sought prior to the fixing step in an electrophotographic process. Therefore, a small half width for the endothermic peak of the wax within the toner is desirable prior to the fixing step. Conversely, reliability of the fixed image is sought after the fixing step. Hence, a large half width for the endothermic peak of the wax within the toner is desirable after the fixing step. It was thus realized that, by having the half width for the endothermic peak of the wax within the toner change before and after passing through the fixing step, the above problems could be resolved.

The toner of the invention has a ratio W1/W2 of the half width W1 (° C.) of a endothermic peak derived from melting of the hydrocarbon wax (hydrocarbon-type wax) in a first temperature rise process on the toner to the half width W2 (° C.) of a endothermic peak derived from melting of the hydrocarbon wax (hydrocarbon-type wax) in a second temperature rise process on the toner, as measured with a differential scanning calorimeter (DSC), which is not less than 0.50 and not more than 0.90.

Here, measurement with a DSC is carried out in accordance with JIS K 7121 (the international standard is ASTM D3418-82). In the practice of the invention, measurement can be carried out using, for example, a Q1000 differential scanning calorimeter (TA Instruments). The melting points of indium and zinc were used for temperature calibration of the apparatus detector, and the heat of fusion for indium was used to calibrate the amount of heat.

Toner measurement was carried out by first precisely weighing out about 10 mg of toner, placing this in an aluminum pan, and using an empty aluminum pan as a reference. In the first temperature rise process, measurement was carried out while raising the temperature of the measurement sample from 20° C. to 200° C. at a rate of 10° C./min. After holding the temperature at 200° C. for 10 minutes, measurement was then continued while carrying out a cooling process that involved cooling from 200° C. to 20° C. at a rate of 10° C./min. After holding the temperature at 20° C. for 10 minutes, in the second temperature rising process measurement was then continued once more while again raising the temperature from 20° C. to 200° C. at a rate of 10° C./min. Based on the DSC curve obtained under these measurement conditions, the half width W1 (° C.) is obtained by calculating the half width of the endothermic peak derived from the wax in the first temperature rise process. Similarly, the half width W2 (° C.) is obtained by calculating the half width of the endothermic peak derived from the wax in the second temperature rise process. In cases where an endothermic peak for this wax overlaps with peaks derived from the binder resin, other waxes or other materials, the half width is determined after carrying out peak separation. As used herein, "half width" refers to the temperature range of an endothermic peak at a height which is one-half the maximum height of the peak from the baseline.

In the first temperature rise process during measurement of the toner with the DSC, the thermal properties of the produced toner itself can be measured. In the second temperature rise process, the thermal properties of toner that has incurred a thermal history in which it has been held for 10 minutes at 200° C. and cooled at 10° C./min can be measured.

Relating this to the process involved in electrophotography, the first temperature rise process measures the thermal properties of the toner before it incurs heating in the fixing step. Next, after melting by what, at 200° C., is thermal energy equivalent to the thermal temperature of fixing step, cooling at 10° C./min then takes place. Hence, the second temperature rise process may be thought of as corresponding to measurement of the thermal properties of the fixed image toner.

In the toner of the invention, the above ratio W1/W2 is not less than 0.50 and not more than 0.90. Within this range, a toner can be obtained for which, before passing through the fixing step, the half width of the endothermic peak of wax is small and, after passing through the fixing step, this half width is large wide. Toners for which the ratio W1/W2 is less than 0.50 also should be able to exhibit the advantageous effects of this invention. However, in the investigations conducted by the inventors, it was not possible to produce such toners. At a ratio W1/W2 higher than 0.90, the effects of the invention are not obtained because the change in the endothermic peak for the wax before and after the fixing step is small.

The inventors thought that art controlling the crystal size of the wax within the toner would be important as art for obtaining a toner having the inventive relationship between W1 and W2. However, the half width of the endothermic peak of the wax is a parameter determined by such factors as the purity of the wax used, the amount of wax added to the toner and the crystal size of the wax. Of these factors, it would be difficult to change the purity of the wax and the amount of wax added to the toner before and after the fixing step. However, with regard to changing the crystal size of the wax before and after the fixing step, the inventors thought this would be possible because the toner does melt once in the fixing step. In general, concerning the relationship between the half width of the endothermic peak observed when crystals melt and the size of the crystals, it is known that in cases where the crystal size is uniform, the half width is small, and in cases where the crystal size is non-uniform, the half width becomes large. Therefore, it was thought that art which makes the crystal size of the wax uniform before the toner fixing step and makes the crystal size non-uniform after melting in the fixing step would be important for practicing this invention.

The toner of the invention is a toner which includes a binder resin, a colorant and a hydrocarbon wax. The inventors have discovered that, in cases where a hydrocarbon wax is used, increasing W2 is easy. The reason is thought to be that, because hydrocarbon wax has a relatively rapid crystallization rate, crystals of various sizes are easily formed while the temperature is lowered in the cooling step after melting under applied heat. Therefore, after melting in the fixing step of the electrophotographic process, crystals of various sizes form in the fixed image as the temperature drops, the wax having a small crystal size being able to contribute to improved slip properties at the image surface, and the wax having a large crystal size being able to contribute to the image strength.

To adjust the relationship between W1 and W2 within the range of this invention, the crystal size of the hydrocarbon wax can be adjusted by including the subsequently described heat treatment step in the toner production process. It is possible, for example, to pass through the subsequently described heat treatment Step (a) and Step (b) in order to make the W1 value for the toner obtained smaller and the W2 value larger.

The hydrocarbon wax preferably used in the invention has the following thermal properties: the endothermic peak derived from melting (melt peak temperature) that is observed when the wax alone is measured with a DSC has a peak temperature of not less than 60° C. and not more than 90° C., and this endothermic peak has a half width which is not less than 2.0° C. and not more than 12.0° C. Having the melt peak temperature and the half width fall in these ranges is preferred because a good balance of heat-resistant storability and low-temperature fixability is easily achieved. Cases in which the melt peak temperature is less than 60° C. are undesirable in terms of the heat-resistant storability, and cases in which the melt peak temperature is higher than 90° C. are undesirable in terms of the low-temperature fixability. Moreover, in cases where the toner of the invention is produced within an aqueous medium, heat treatment at a temperature not less than 10° C. higher than the extrapolated melting completion temperature of the wax in the subsequently described Step (a) may become impossible to carry out. In cases where the half width is less than 2.0° C., the W2 value may not be sufficiently large even when employing the embodiments of the present invention; conversely, when the half width is larger than 12.0° C., the W1 value may not be sufficiently small. However, with regard to the thermal properties of the wax alone that is used, because these fluctuate according to such factors as the binder resin and colorant within the toner, the structure and compounding ratio with other materials and the toner production conditions, no limitations are imposed on the thermal properties of the wax alone. Measurement of the thermal properties of the wax alone can be carried out by a method and under measurement conditions similar to those of the method according to JIS K 7121 mentioned above. Concerning this melt peak temperature and half width, the values obtained in the second temperature rise process are used in order to exclude the thermal history such as the wax production conditions and storage conditions. As used herein, "melt peak temperature" refers to the temperature when the peak height from the base line is at its highest point.

The hydrocarbon wax used in this invention is a hydrocarbon wax obtained by the extraction and fractionation of specific components from, for example, low-molecular-weight alkylene polymers obtained by the radical polymerization of alkylene under high pressure or the polymerization of alkylene with a Ziegler catalyst under low pressure, alkylene polymers obtained by the pyrolysis of a high-molecular-weight alkylene polymer, and synthetic hydrocarbons obtained by hydrogenating the distillation residue of a hydrocarbon obtained by the ARGE method from a synthesis gas composed of carbon monoxide and hydrogen. The fractionation of hydrocarbon wax is carried out by a press sweating method, a solvent method, or a fractionation crystallization process that uses vacuum distillation. That is, examples of the hydrocarbon wax include ones obtained by using these methods to remove low-molecular-weight components or to extract low-molecular-weight components, and ones obtained by using these methods to further remove low-molecular-weight components from either of the foregoing.

The hydrocarbons of which the hydrocarbon wax is made are synthesized by the reaction of carbon monoxide and hydrogen using a metal oxide catalyst (usually a multicomponent system of two or more catalysts). For example, hydrocarbons of up to several hundred carbons obtained by the synthol method, the hydrocol method, or the ARGE method (from which many waxy hydrocarbons can be obtained), and hydrocarbons obtained by the polymerization of alkylenes such as ethylene with a Zeigler catalyst are preferred. Hydrocarbon waxes synthesized by a process that does not rely on alkylene polymerization are especially preferred, both because of their structure and because they have a molecular weight distribution which is easily fractionated.

In a specific embodiment of the invention, because the subsequently described Step (a) includes a step in which resin and wax are intimately mixed together, by having the difference in the solubility parameters (sometimes abbreviated below as "SP") between the binder resin and the wax be 2.0 or less, intimate mixture is easy, which is desirable. The SP value is calculated by Fedor's method. Specifically, as explained in detail in *Polym. Eng. Sci.*, Vol. 14, p. 147 (1974), the SP value is calculated by the following equation:

$$SP=\sqrt{(Ev/v)}=\sqrt{(\Sigma\Delta ei/\Sigma\Delta vi)}$$

(where Ev is the evaporation energy (cal/mol); v is the molar volume (m/mol), Δei represents the evaporation energies of the respective atoms or atomic groups; and Δvi represents the molar volumes of the respective atoms or atomic groups).

Details on this method of calculation are given in, for example: *Gijutsusha no tame no Jitsugaku Kōbunshi* [Practical polymer science for scientists and engineers], by Junji Mukai et al., p. 66 (Kodansha, 1981); and *Polymer Handbook* (4th edition, a Wiley-Interscience Publication). A similar method is used in the present embodiment.

The preferred ranges in the molecular weight distribution of the hydrocarbon wax are a number-average molecular weight (Mn) of not less than 500 and not more than 1200, a weight-average molecular weight (Mw) of not less than 800 and not more than 4000, and a peak molecular weight (Mp) of not less than 700 and not more than 3000. By conferring the hydrocarbon wax with such a molecular weight distribution, the toner can be imparted with desirable thermal properties. That is, at a molecular weight smaller than the above range, the thermal influence tends to become excessive, the blocking resistance and developability become inferior. And the molecular weight becomes larger than the above range. As a result, heat from the exterior cannot be effectively used, and an excellent fixing performance and offset resistance cannot be obtained.

Other physical properties of the hydrocarbon wax are a density at 25° C. which is not less than 0.95 g/cm$^3$, and a penetration of not more than 1.5 ($10^{-1}$ mm), and preferably not more than 1.0 ($10^{-1}$ mm). Outside of these ranges, the hydrocarbon wax readily deforms at low temperature, and thus tends to have an inferior storability and developability.

The melt viscosity of the hydrocarbon wax at 140° C. is not more than 100 cP, preferably not more than 50 cP, and most preferably not more than 20 cP. At a melt viscosity higher than 100 cP, the plasticity and release properties worsen, and the outstanding fixing performance and offset resistance are adversely affected. The softening point is preferably not more than 130° C., and most preferably not more than 120° C. At a softening point higher than 130° C., the temperature at which the releasability acts most effectively becomes high, adversely affecting the offset resistance.

In addition, the acid value of the hydrocarbon wax is less than 2.0 mg KOH/g, and preferably less than 1.0 mg KOH/g. Above this range, the interfacial adhesive strength with the binder resin is large and phase separation during melting tends to become inadequate. As a result, a good releasability is difficult to obtain and the offset resistance at elevated temperature is poor. Moreover, an adverse influence is imparted on the triboelectric charging characteristics of the toner, sometimes giving rise to problems with the developability and durability.

The content of these hydrocarbon waxes is preferably not more than 20 mass parts per 100 mass parts of the binder resin. The use of not less than 2 mass parts and not more than 15 mass parts is more preferred and effective.

The molecular weight distribution of hydrocarbon wax in this invention is measured under the following conditions by gel permeation chromatography (GPC).

(GPC Measurement Conditions)

Apparatus: GPC-150C (Waters Associates, Inc.)

Columns: a series of two GMH-HT 30-cm columns (Tosoh Corporation)

Temperature: 135° C.

Solvent: o-dichlorobenzene (to which 0.1% Ionol has been added)

Flow rate: 1.0 mL/min

Sample: 0.4 mL of a 0.15% sample was injected

In carrying out measurement under the above conditions and calculating the molecular weight of the sample, use is made of a molecular weight calibration curve prepared with monodisperse polystyrene standard samples. In addition, calculation is carried out by polyethylene conversion with a conversion formula derived from the Mark-Houwink viscosity formula.

The penetration of waxes in this invention is a value measured in general accordance with JIS K-2207. This is a numerical value, expressed in 0.1 mm units, of the depth of penetration when an indenter having a diameter of about 1 mm and a conical tip with a peak angle of 9° is caused to penetrate the sample under a fixed load. The test conditions in this invention were a sample temperature of 25° C., an applied load of 100 g, and a penetration time of 5 seconds.

The melt viscosity of the hydrocarbon wax is a value measured using a Brookfield viscometer under the following conditions: measurement temperature, 140° C.; shear rate, 1.32 rpm; sample, 10 mL.

The acid value is the number of milligrams of potassium hydroxide required to neutralize the acid groups present in 1 g of sample, and is determined in accordance with JIS K5902. The density is a value measured at 25° C. in accordance with JIS K6760, and the softening point is a value measured in accordance with JIS K2207.

A hydrocarbon wax is included in the embodiments of the invention. However, where necessary, it is also possible to use in combination therewith: amide waxes, higher fatty acids, long-chain alcohols, ester waxes, ketone waxes, and also derivatives of these such as graft compounds and block compounds.

A method of producing toner is also included herein as a specific embodiment of the invention. This toner production method includes a step in which toner is heat-treated under the conditions of Step (a) and Step (b) below, with Step (a) being carried out before Step (b).

Step (a): In this step, the toner is heat-treated for not less than 60 minutes at a temperature not less than 10° C. higher than the extrapolated melting end temperature of the hydrocarbon wax, as measured with a differential scanning calorimeter in the presence of the binder resin and the hydrocarbon wax.

Step (b): In this step, the toner is heat-treated for not less than 60 minutes at a temperature within the temperature range of the exothermic peak derived from crystallization of the hydrocarbon wax, as measured with a differential scanning calorimeter, and such that the temperature fluctuation range centered on a temperature below the extrapolated melting onset temperature of the hydrocarbon wax is not more than 4.0° C.

By passing through these steps, it was found that a toner in which the W1 of the produced toner was small and the W2 was large can be obtained.

The reason is conjectured to be as follows. By thoroughly and intimately mixing together the wax and the binder resin and subsequently effecting crystallization in Step (a) during toner production, crystals of various sizes are more easily formed than when the wax alone is crystallized. Also, it is thought to be necessary for the wax to be melted sufficiently once in Step (a) in order to control the crystal size of the wax in Step (b). Next, crystallization of the wax can be promoted by carrying out heat treatment under the temperature conditions in Step (b). Generally, crystallization of the wax arises by carrying out heat treatment within the temperature range of the exothermic peak derived from crystallization. However, melting of the crystallized wax occurs within the temperature range at which melting of the wax arises, which must be avoided. In investigations conducted by the inventors, it was found that a small W1 can be obtained by setting the range of temperature fluctuation during heat treatment in Step (b) to 4.0° C. or less. This is presumably because the wax could be controlled to a uniform size. The half width does not become small enough when the heat treatment time is short, so heat treatment must be carried out for not less than 60 minutes.

In Step (b), "within the temperature range of the exothermic peak . . . and . . . centered on a temperature below the extrapolated melting onset temperature of the hydrocarbon wax" means that some specific temperature which satisfies the respective temperature conditions is set as the center temperature.

In Step (a), from the standpoint of time efficiency during toner production, the upper limit in the length of time that heat treatment is carried out is preferably not more than 720 minutes, and more preferably not more than 240 minutes.

Also, in Step (b), from the standpoint of time efficiency during toner production, the upper limit in the length of time that heat treatment is carried out is preferably not more than 2880 minutes, and more preferably not more than 640 minutes.

One of the elements in the above production method is the temperatures of the peaks derived from wax melting and crystallization. However, these are not values for a material (wax) alone, but rather values for the toner obtained using the material. An intimate relationship exists between the thermal properties of a material (wax) alone and the thermal properties of the toner obtained using this material, but this relationship varies also with the structure and compounding ratio of the binder resin, colorant and the like, or with the toner production method, and thus does not impose a limitation on the thermal properties of the wax itself. Measurement is carried out under the same conditions as in the method described above. The extrapolated melting onset temperature and the extrapolated melting end temperature of the wax are values taken from the second temperature rise process. The wax crystallization peak is a value taken from the cooling process. Here, the extrapolated melting onset temperature and the extrapolated melting end temperature were determined in general accordance with JIS K 7121. That is, the extrapolated melting onset temperature is the temperature at the intersection between the straight line obtained by extending the base line on the low-temperature side toward the high-temperature side and the tangent drawn to the curve on the low-temperature side of the melting peak at the point where the slope reaches a maximum. The extrapolated melting end temperature is the temperature at the intersection between the straight line obtained by extending the base line on the high-temperature side to the low-temperature side and the tangent drawn to the curve on the high-temperature side of the melting peak at the point where the slope reaches a maximum. Because crystallization continues gradually in the cooling process, the wax crystallization peak often cannot be suitably determined from the extrapolated crystallization melting end temperature. Hence, the rise temperatures are determined from the respective baselines on the low-temperature side and high-temperature side of the exothermic peak derived from crystallization, and these are treated as the temperature range of the exothermic peak derived from wax crystallization. The rise temperatures are the temperatures where the peak curve can be seen to clearly move away from the base line. That is, these are temperatures where the peak curve differential values are positive and the increase in differential values starts to become large, or temperatures where the differential values change from negative to positive.

The heat treatment step must be carried out in the presence of a binder resin and a hydrocarbon wax. Therefore, in the case of production by a polymerization process, it is preferable for polymerization to be carried out at a polymerization ratio of not less than 80%, and preferably not less than 95%. The heat treatment step is not subject to any particular limitation, provided it is carried out in the presence of a binder resin and a hydrocarbon wax. In cases where the toner is produced by a dry production process, Step (a) may be carried out during melt kneading or after melt kneading, and Step (b), provided it is carried out after Step (a), may be carried out directly after Step (a) or may be carried out after, for example, coarse pulverization and fine pulverization, or after external addition. In cases where the toner is produced by a wet production process, Step (a) may be carried out during the reaction or after the reaction, and Step (b), provided it is carried out after Step (a), may be carried out directly after Step (a) or may be carried out while carrying out drying or subsequent to drying. In a wet production process, carrying out Step (a) in a state where the toner has been dispersed in a dispersing medium is preferred from the standpoint of preventing melt adhesion.

The polymerization ratio when producing the toner by a polymerization process can be measured and calculated as described below by using gas chromatography (GC) to quantitatively determine unreacted styrene in the toner particles.

In the polymerization step, the dispersion of the polymerizable monomer composition is sampled, and 0.4 g is precisely weighed and placed in a sample bottle. Next, 15 g of precisely weighed acetone is added and the bottle is capped, following which the contents are thoroughly mixed, then ultrasonically irradiated for 30 minutes using a desktop ultrasonic cleaner having an oscillating frequency of 42 kHz an electrical power of 125 W (e.g., that available from Branson under the trade name B2510-J-MTH). Next, filtration is carried out using a solvent-resistant membrane filter having a pore size of 0.2 μm (My Shori Disk, from Tosoh Corporation), following which 2 μL of filtrate is analyzed by gas chromatography. The amount of unreacted styrene is then calculated by means of a calibration curve prepared beforehand using styrene and, based on the ratio of this with the total amount of styrene extracted with acetone, the polymerization ratio is measured.

The measurement apparatus and measurement conditions that can be used are as follows.

GC: 6890 GC, from HP
Column: INNOWax, from HP (200 μm×0.40 μm×25 m)
Carrier Gas: He (constant pressure mode: 20 psi)
Oven: (1) hold at 50° C. for 10 minutes, (2) raise temperature to 200° C. at 10° C./min, (3) hold at 200° C. for 5 minutes
Injection port: 200° C., pulsed split-less mode (20→40 psi, until 0.5 minutes)
Split ratio: 5.0:1.0
Detector: 250° C. (FID)

Evaluations were carried out on toners obtained in the above embodiment of the invention, from which it was found that toners having a good balance of low-temperature fixability and heat-resistant storability and also having an excellent fixed image reliability can be obtained. Moreover, owing to the effects of heterogeneity, although hydrocarbon wax tends to bleed out easily, such bleedout did not readily arise even with long-term standing in a high-temperature, high-humidity environment. Hence, the thermal properties remained relatively unchanged over time. As a result, even toner that was stored for a long time in a high-temperature, high-humidity environment was found to incur little change over time in developability. This is presumably because, given the uniform size of wax crystals in the toner, toner strain was limited, as a result of which stress relaxation did not easily arise even on long-term standing in a high-temperature, high-humidity environment.

In a more preferred form of the inventive toner, the ratio Q1/Q2 of the amount of heat absorption Q1 (J/g) of a peak derived from melting of the hydrocarbon wax in the first temperature rise process to the amount of heat absorption Q2 (J/g) of a peak derived from melting of the hydrocarbon wax in the second temperature rise process is not less than 1.1 and not more than 1.5. In addition, it is especially preferable for the difference Tg1−Tg2 between an extrapolated glass transition onset temperature Tg1 (° C.) in the first temperature rise process on the toner and an extrapolated glass transition onset temperature Tg2 (° C.) in the second temperature rise process on the toner, as measured with a differential scanning calorimeter, to be not less than 5.0° C. and not more than 15.0° C.

Here, Q1, Q2, Tg1 and Tg2 are determined by DSC measurement under the same conditions as in the method described above. Calculation of Q1 and Q2 is carried out in general accordance with JIS K 7122, with the amounts of absorbed heat Q1 and Q2 being determined from the surface area of the region formed by connecting the points where the curve moves away from the base line and the points where the curve returns to the base line before and after transition. In cases where the endothermic peak of this wax overlaps with peaks derived from the binder resin, other waxes and other materials, the amount of absorbed heat is determined after carrying out peak separation. Calculation of Tg1 and Tg2 is carried out in general accordance with JIS K 7121, these values being the temperature at the intersection between a direct line obtained by extending the base line on the low-temperature side toward the high-temperature side and the tangent drawn at the point where the slope of the curve in the region of stepwise change in glass transition reaches a maximum. In cases where the region of stepwise change and the endothermic peak due to enthalpy relaxation overlap and determining the extrapolated glass transition onset temperature by the above method is difficult, the extrapolated onset temperature of the endothermic peak due to enthalpy relaxation is used as the extrapolated glass transition onset temperature.

One way to adjust the Q1/Q2 value and the Tg1/Tg2 value to the ranges of this invention is to control the degree of crystallization of the hydrocarbon wax. The method for doing so may be, for example a method that involves adjusting the temperature and time of heat treatment in Step (b).

Toners for which the relationship between Q1 and Q2 and the relationship between Tg1 and Tg2 fall within the above range have an even better heat-resistant storability, change over time in thermal properties of the toner in high-temperature, high-humidity environments, and low-temperature fixability. As with the W1 and W2 described above, Q1, Q2, Tg1 and Tg2 are thought to correspond to, respectively, the thermal properties of the toner before the fixing step and the thermal properties after the fixing step. That is, the above Q1 and Tg1 are presumed to correspond to the amount of absorbed heat by the wax and the wax glass transition temperature before the toner incurs heating in the fixing step, and the above Q2 and Tg2 are presumed to correspond to the amount of absorbed heat by the wax and the wax glass transition temperature after the toner has incurred heating in the fixing step. Therefore, toners for which the relationship between Q1 and Q2 and the relationship between Tg1 and Tg2 fall within the above-indicated ranges are advantageous from the standpoint of the heat-resistant storability and the change over time in toner storage because, prior to the fixing step, the wax has crystallized, resulting in a large glass transition temperature. Moreover, when heat has been incurred in the fixing step, the wax and the binder resin intimately mix, lowering the glass transition temperature, which appears to be advantageous from the standpoint of low-temperature fixing.

The preferred ranges of Q1 and Q2 in the toner of the invention vary depending on the amount of wax added to the toner and thus cannot be strictly set, although the preferred range for Q1 is not less than 3 J/g and not more than 20 J/g, and the preferred range for Q2 is not less than 2 J/g and not more than 20 J/g.

The preferred range for Tg1 is not less than 45° C. and not more than 65° C., and the preferred range for Tg2 is not less than 30° C. and not more than 60° C. When Tg1 is less than 45° C., this is undesirable from the standpoint of the heat-resistant storability of the toner, and when Tg1 is higher than 65° C., this is undesirable from the standpoint of the low-temperature fixability. In addition, when Tg2 is less than 30° C., this is undesirable from the standpoint of the document offset properties of the fixed image, and when Tg2 is higher than 60° C., this is undesirable from the standpoint of the low-temperature fixability.

The inventive toner and the inventive toner production method may be used in, for example, a dry production process such as pulverization method. Alternatively, they may be used in a wet production process such as suspension polymerization method.

In the production of the inventive toner by a pulverization process, the binder resin, hydrocarbon wax, colorant and, optionally, metal compounds, magnetic material, charge control agent and other additives are thoroughly mixed in a mixer such as a Super Mixer, a Henschel mixer, a ball mill or a Nauta mixer (mixing step); melt-kneaded using a hot kneader such as heated rolls, kneader or extruder, thereby dispersing or dissolving the metal compound, pigment, dye and magnetic material in an intimate mixture of the resins (melt-kneading step); cooled and then solidified and pulverized using a pulverizing apparatus such as a jet mill, Turbo Mill, Kryptron System or Inomizer system (pulverizing step); then classified using a classifier such as an elbow jet, Turboplex or Dispersion Separator classifier.

Polymers that may be used as the binder resin include polystyrene; homopolymers of styrene substitution products, such as poly-p-chlorostyrene and polyvinyltoluene; styrene copolymers such as styrene-p-chlorostyrene copolymer, styrene-vinyl toluene copolymer, styrene-vinyl naphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenol resins, natural resin-modified phenolic resins, natural resin-modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, coumarone-indene resins and petroleum-based resins. Styrene-based copolymers and polyester resins are preferred as the binder resin.

Illustrative examples of co-monomers suitable for use with the styrene monomer in styrene-based copolymers include monocarboxylic acids having a double bond and substitution products thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and substitution products thereof, such as maleic acid, butyl maleate, methyl maleate and dimethyl maleate; vinyl esters such as vinyl chloride, vinyl acetate and vinyl benzoate; ethylenic olefins such as ethylene, propylene and butylene; vinyl ketones such as vinyl methyl ketone and vinyl hexyl ketone; and vinyl ethers such as vinyl methyl ether, vinyl ethyl ether and vinyl isobutyl ether. These vinyl monomers may be used singly or two or more may be used in combination. The styrene-based homopolymer or styrene-based copolymer may be crosslinked or may be a mixed resin.

A compound having two or more polymerizable double bonds may be used primarily as the crosslinking agent for the binder resin. Illustrative examples include aromatic divinyl compounds such as divinyl benzene and divinyl naphthalene; carboxylic acid esters having two double bonds, such as ethylene glycol diacrylate, ethylene glycol dimethacrylate, and 1,3-butanediol dimethacrylate; divinyl compounds such as divinyl aniline, divinyl ether, divinyl sulfide and divinyl sulfone; and compounds having three or more vinyl groups. These crosslinking agents may be used singly or as mixtures thereof. Any of the following methods may be used to synthesize the styrene-based copolymer: bulk polymerization, solution polymerization, suspension polymerization and emulsion polymerization.

In bulk polymerization method, by carrying out polymerization at an elevated temperature and speeding up the rate of the termination reaction, a low-molecular-weight polymer can be obtained, although a drawback is that the reaction is difficult to control. In the solution polymerization method, a low-molecular-weight polymer can be easily obtained under mild conditions; this is preferred when obtaining a styrene-based polymer having a maximum molecular weight in the range of not less than 5000 and not more than 100000.

Xylene, toluene, cumene, cellosolve acetate, isopropyl alcohol and benzene may be used as the solvent in solution polymerization. In the case of a styrene monomer mixture, xylene, toluene or cumene is preferred. The solvent is suitably selected according to the polymer to be formed by polymerization.

The reaction temperature varies with the solvent and initiator used and the polymer to be polymerized, although polymerization is preferably carried out at a temperature of not less than 70° C. and not more than 230° C. Solution polymerization is preferably carried out with not less than 30 mass parts and not more than 400 mass parts of monomer per 100 mass parts of the solvent. Mixing another polymer into the solution when polymerization is complete is also preferred. A plurality of polymers can be thoroughly mixed.

Emulsion polymerization is a method in which a substantially water-insoluble monomer is dispersed in an aqueous phase as small particles with the help of an emulsifying agent and polymerization is carried out using a water-soluble polymerization initiator. In this method, adjustment of the heat of reaction is easy and, because the phase in which polymerization is carried out (an oil phase composed of polymer and monomer) and the aqueous phase are separate, the termination reaction rate is low, as a result of which the polymerization rate is high, enabling polymer having a high degree of polymerization to be obtained. In addition, for a variety of reasons, including the fact that the polymerization process is relatively simple and, because the polymerization product is in the form of fine particles, mixing with colorant, charge control agent and other additives in toner production is easy, this method is excellent as a method of producing a binder resin for toner.

However, because of the emulsifying agent that has been added, the resulting polymer tends to become impure, necessitating an operation such as salting out to remove the polymer. Hence, suspension polymerization is easy and especially preferred.

In suspension polymerization, first, a polymerizable monomer composition is formed by uniformly dissolving or dispersing a polymerizable monomer for synthesizing the binder resin, a hydrocarbon wax, and a colorant with an agitator such as a homogenizer and an ultrasonic disperser (polymer composition preparation step). Next, liquid drops composed of the polymerizable monomer composition are granulated to the desired toner particle size in a dispersant-containing aqueous phase using a disperser having a high shear force (granulation step). It is desirable to carry this out using not more than 100 mass parts (preferably not less than 10 mass parts and not more than 90 mass parts) of monomer per 100 mass parts of the aqueous solvent. Polymerization is carried out after setting the polymerization temperature to generally not less than 50° C. and not more than 90° C., thereby obtaining a toner particle dispersion (polymerization step). When a polymerization initiator is added, polymerization can be carried out at in a desired period and for the required length of time. Alternatively, the temperature may be raised in the last half of the polymerization reaction in order to obtain the desired molecular weight distribution. In addition, a portion of the aqueous medium may be driven off by a distillation operation in the last half of the reaction or following reaction completion in order to remove unreacted polymerizable monomer, by-product and the like from the system. The distillation operation may be carried out at standard pressure or reduced pressure.

In suspension polymerization, dispersion stabilizers for dispersing the polymerizable monomer composition in the aqueous medium are generally divided broadly into polymers which manifest repulsive forces due to steric hindrance and poorly soluble inorganic compounds which are intended to disperse and stabilize by way of electrostatic repulsive forces. Fine particles of poorly soluble inorganic compound are dissolved by an acid or an alkali and thus can be advantageously used because, following polymerization, they can be easily dissolved and removed by washing with an acid or an alkali.

As dispersion stabilizers that are poorly water-soluble inorganic compounds, preferred use can be made of compounds containing any one of the following: magnesium, calcium, barium, zinc, aluminum and phosphorus. The use of a compound containing any one from among magnesium, calcium, aluminum and phosphorus is even more preferred. Illustrative examples include magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate and hydroxyapatite.

Organic compounds which may be concomitantly used in the above dispersion stabilizer include polyvinyl alcohol, gelatin, methyl cellulose, methyl hydroxypropyl cellulose, ethyl cellulose, the sodium salt of carboxymethyl cellulose, and starch. These dispersion stabilizers are preferably used in an amount of not less than 0.01 mass parts and not more than 2.00 mass parts per 100 mass parts of the polymerizable monomer.

To make such dispersion stabilizers even finer in size, not less than 0.001 mass % and not more than 0.1 mass % of a surfactant may be used together. Commercially available nonionic, anionic and cationic surfactants may be used for this purpose. For example, preferred use can be made of sodium dodecyl sulfate, sodium tetradecyl sulfate, sodium pentadecyl sulfate, sodium octyl sulfate, sodium oleate, sodium laurate, potassium stearate and calcium oleate.

The polymerization initiators used in these polymerization processes are oil-soluble initiators and/or water-soluble initiators. Illustrative examples of oil-soluble initiators include azo compounds such as 2,2'-azobisisobutyronitrile, 2,2'-azobis-2,4-dimethylvaleronitrile, 1,1'-azobis(cyclohexane-1-carbonitrile) and 2,2'-azobis-4-methoxy-2,4-dimethylvaleronitrile; and peroxide initiators such as acetyl cyclohexylsulfonyl peroxide, diisopropyl peroxycarbonate, decanonyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide and cumene hydroperoxide.

Illustrative examples of water-soluble initiators include ammonium persulfate, potassium persulfate, 2,2'-azobis(N,N'-dimethyleneisobutyroamidine) hydrochloride, 2,2'-azobis(2-amidinopropane) hydrochloride, azobis(isobutylamidine) hydrochloride, sodium 2,2'-azobisisobutyronitrile sulfonate, ferrous sulfate and hydrogen peroxide.

These polymerization initiators may be used singly or in combination. In order to control the degree of polymerization of the polymerizable monomers, it is also possible to additionally add and use a chain transfer agent, a polymerization inhibitor and the like.

Next, the composition of the polyester resin is described. The polyester resin may be obtained by using the alcohol components and acid components shown below and carrying out a commonly known condensation polycondensation.

Illustrative examples of divalent alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol and derivatives thereof, and diols.

Illustrative examples of divalent acid components include the following dicarboxylic acids and derivatives thereof: benzenedicarboxylic acids such as phthalic acid, terephthalic acid, isophthalic acid and phthalic anhydride, as well as anhydrides or lower alkyl esters thereof; alkyldicarboxylic acids such as succinic acid, adipic acid, sebacic acid and azelaic acid, as well as anhydrides or lower alkyl esters thereof; alkenylsuccinic acids or alkylsuccinic acids such as n-dodecenylsuccinic acid and n-dodecylsuccinic acid, as well as anhydrides or lower alkyl esters thereof; and unsaturated dicarboxylic acids such as fumaric acid, maleic acid, citraconic acid and itaconic acid, as well as anhydrides or lower alkyl esters thereof.

In addition, the concomitant use of alcohol components having a functionality of 3 or more and acid components having a functionality of 3 or more as the crosslinking agent is advantageous.

Illustrative examples of polyhydric alcohol components having a functionality of 3 or more include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Illustrative examples of polycarboxylic acid components having a functionality of 3 or more include the following polycarboxylic acids and derivatives thereof: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol® trimer acids, as well as anhydrides and lower alkyl esters thereof; and tetracarboxylic acids, as well as anhydrides and lower alkyl esters thereof.

Of the number of moles of all the ingredients, the alcohol component accounts for preferably not less than 40 mol % and not more than 60 mol %, and more preferably not less than 45 mol % and not more than 55 mol %; and the acid component accounts for preferably not less than 40 mol % and not more than 60 mol %, and more preferably not less than 45 mol % and not more than 55 mol %.

Polyvalent ingredients having a functionality of 3 or more account for preferably not less than 1 mol % and not more than 60 mol % of all the ingredients.

Aside from the above binder resin component, examples of compounds that may be included within the toner of the invention in a proportion smaller than the content of the binder resin component include: silicone resins, polyurethanes, polyamides, epoxy resins, polyvinyl butyrals, rosins, modified rosins, terpene resins, phenolic resins, and copolymers of two or more different α-olefins.

As mentioned above, it is preferable for the binder resin used in the invention to have an SP value difference with the wax of not more than 2.0. Also, it is preferable to use a low-molecular-weight resin having a peak molecular weight, as measured by GPC, of not less than 5000 and not more than 30000 together with a high-molecular-weight resin having a weight-average molecular weight of not less than 150000, a resin having a crosslinked component that has become a THF-insoluble component (gel component), or a resin which has become a gel component. The low-molecular-weight resin and the high-molecular-weight resin or gel component-containing resin may be wet-mixed in a solvent or may be dry-mixed at the time of toner production. Moreover, it may be a resin that has become a gel component within a low-molecular-weight resin, or a resin in which a gel component has been dispersed. Alternatively, the high-molecular-weight resin, gel component-containing resin and gel component may be synthesized in the presence of a low-molecular-weight resin. Or the low-molecular-weight resin may be synthesized in the presence of a high-molecular-weight resin, a gel-containing resin and a gel component. Mixture and use with a resin having another molecular weight is also possible. The molecular weight distribution in a chromatogram obtained by GPC of the binder resin and the toner is measured under the following conditions. The column is stabilized within a 40° C. heat chamber, tetrahydrofuran (THF) as the solvent is passed at a flow rate of 1 mL/min through the column at this temperature, and about 100 μL of the THF sample solution is injected and measured. In molecular weight measurement of the sample, the molecular weight distribution of the sample is calculated from the relationship between the logarithmic value on a calibration curve created using several different monodisperse polystyrene standard samples and the count. It is suitable to use, as the standard polystyrene samples for creating the calibration curve, about ten standard polystyrene samples produced by, for example, Tosoh Corporation or Showa Denko KK which have a molecular weight of not less than about $10^2$ and not more than about $10^7$. A refractive index (RI) detector is used as the detector. The column may be a combination of several commercially available polystyrene gel columns, such as the combination of Shodex GPC KF-801, 802, 803, 804, 805, 806, 807 and 800P columns from Showa Denko KK; and the combination of TSKgel G1000H (HXL), G2000H (HXL), G3000H (HXL), G4000H (HXL), G5000H (HXL), G6000H (HXL), G7000H (HXL) and TSKguard columns from Tosoh Corporation.

The samples are prepared as follows. A sample is placed in THF and left to stand for several hours, after which it is thoroughly shaken and thereby mixed well with THF (until coalesced bodies of the sample disappear), following which it is left at rest for not less than 12 hours. The length of time the sample is left to stand in THF at this time is set to not less than 24 hours. Thereafter, what has passed through a sample treatment filter (having a pore size of not less than 0.45 μm and not more than 0.5 μm, such as a My Shori Disk H-25-5 from Tosoh Corporation, or an Ekicrodisc 25CR from Gelman Science Japan) is treated as the GPC sample. The sample concentration is adjusted so that the resin component is not less than 0.5 mg/mL and not more than 5 mg/mL.

Known colorants may be used as the colorant in the inventive toner, and may be selected based on hue angle, chroma, lightness, weather resistance, OHP transparency, and dispersibility in the toner.

Black colorants used may be carbon black, magnetic material, and ones that have been adjusted to a black color using the yellow/magenta/cyan colorants shown below.

Yellow colorants that may be used include the following pigment systems: condensed azo compounds, isoindolinone compounds, anthraquinone compounds, azo metal complex methine compounds and allylamide compounds. Preferred examples include C.I. Pigment Yellow 3, 7, 10, 12 to 15, 17, 23, 24, 60, 62, 74, 75, 83, 93 to 95, 99, 100, 101, 104, 108 to 111, 117, 123, 128, 129, 138, 139, 147, 148, 150, 166, 168 to 177, 179, 180, 181, 183, 185, 191:1, 191, 192, 193 and 199. Exemplary dye systems include C.I. Solvent Yellow 33, 56, 79, 82, 93, 112, 162 and 163, and C.I. Disperse Yellow 42, 64, 201 and 211. Magenta pigments that may be used include condensed azo compounds, diketopyrrolopyrrole compounds, anthraquinone and quinacridone compounds, basic dye lake compounds, naphthol compounds, benzimidazolone compounds, thioindigo compounds and perylene compounds. Preferred examples include C.I. Pigment Red 2, 3, 5 to 7, 23, 48:2, 48:3, 48:4, 57:1, 81:1, 122, 146, 166, 169, 177, 184, 185, 202, 206, 220, 221 and 254, and C.I. Pigment Violet 19.

Cyan pigments that may be used include copper phthalocyanine compounds and derivatives thereof, anthraquinone compounds, and basic dye lake compounds. Preferred examples include C.I. Pigment Blue 1, 7, 15, 15:1, 15:2, 15:3, 15:4, 60, 62 and 66.

These colorants may be used singly or in admixture, and moreover may be used in a solid solution state. Such pigments are preferably used by addition in an amount of not less than 0.5 mass parts and not more than 20 mass parts per 100 mass parts of the binder resin.

Also, the toner of the invention may have a magnetic material included therein and may be used as a magnetic toner. In such a case, the magnetic material may also serve as a colorant. In the practice of the invention, the magnetic material included in a magnetic toner is exemplified by iron oxides such as magnetite, hematite and ferrite; metals such as iron, cobalt and nickel, and alloys or mixtures of the foregoing metals with metals such as aluminum, cobalt, copper, lead, magnesium, tin, zinc, antimony, beryllium, bismuth, cadmium, calcium, manganese, selenium, titanium, tungsten and vanadium.

The magnetic material used in the invention is more preferably a surface-modified magnetic material; when used in a toner produced by a polymerization process, it is preferably a magnetic material that has been subjected to hydrophobic treatment with a surface modifying agent which is a substance that does not inhibit polymerization. Such surface modifying agents are exemplified by silane coupling agents and titanium coupling agents.

By blending (internally adding) or mixing (externally adding) a charge control agent to the toner of the invention, the toner charge quantity can be controlled to the desired value.

Illustrative examples of toner positive charge control agents include nigrosin and modified forms thereof obtained with fatty acids and the like; quaternary ammonium salts such as tributylbenzylammonium-1-hydroxy-4-naphtholsulfonate and tetrabutylammonium tetrafluoroborate, and also onium salts such as phosphonium salts that are analogs thereof as well as lake pigments of the same, triphenylmethane dyes and lake pigments thereof, and metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. These may be used singly or two or more may be used in combination. Of the foregoing, the use of a charge control agent such as a nigrosin compound, a quaternary ammonium salt or a triphenylmethane dye is especially preferred.

Organic metal complexes and chelating compounds are effective as toner negative charge control agents. Exemplary metal complexes include monoazo metal complexes, acetylacetone metal complexes, and aromatic hydroxycarboxylic acid-type and aromatic dicarboxylic acid-type metal complexes. In addition, there are also aromatic hydroxycarboxylic acids, aromatic mono- and polycarboxylic acids, as well as metal salts, anhydrides and esters thereof, and also phenol derivatives such as bisphenol.

When these charge control agents are internally added to a toner, addition in an amount of not less than 0.1 mass % and not more than 10 mass % with respect to the binder resin is preferred.

With regard to the particle diameter of the toner in this invention, from the standpoint of high precision and high resolution of the image, the weight-average particle diameter is preferably not less than 3.0 μm and not more than 10.0 μm. The weight-average particle diameter of the toner can be measured by the pore electrical resistance method. Measurement and calculation may be carried out using, for example, the Coulter Counter Multisizer 3® (manufactured by Beckman Coulter) and dedicated software (Beckman Coulter Multisizer 3, Version 3.51 (from Beckman Coulter)) furnished therewith for setting the measurement conditions and analyzing the measurement data.

In the toner of the invention, externally adding a fine powder such as silica, alumina or titania is preferred for enhancing the charge stability, developability, flowability and durability. Such external addition may be used to obtain the toner by adding the desired additive to the toner particles and using a mixing apparatus such as a Super Mixer or a Henschel mixer to effect thorough mixture.

Silica, alumina and titania fine powders used as the external additive provide good results when the specific surface area, as measured by the BET method using nitrogen adsorption, is not less than 20 $m^2/g$ (and especially not less than 30 $m^2/g$ and not more than 400 $m^2/g$). These fine powders are used in an amount, per 100 mass parts of the toner, of preferably not less than 0.01 mass parts and not more than 8 mass parts, and more preferably not less than 0.1 mass parts and not more than 5 mass parts.

It is preferable for the above fine powder to be optionally treated with a treatment agent that is an organosilicon compound, examples of which include silicone varnishes, various types of modified silicone varnishes, silicone oils, modified silicone oils, silane coupling agents and silane coupling agents having functional groups, or with an organosilicon compound in combination with another type of treatment agent, for such purposes as to render the toner hydrophobic or to control the charging performance.

Adding the following inorganic powders in order to enhance the developability and durability is also preferred: oxides of metals such as magnesium, zinc, aluminum, cerium, cobalt, iron, zirconium, chromium, manganese, strontium, tin and antimony; combined metal oxide such as calcium titanate, magnesium titanate and strontium titanate; metal salts such as calcium carbonate, magnesium carbonate and aluminum carbonate; clay minerals such as kaolin; phosphate compounds such as apatite; silicon compounds such as silicon carbonate and silicon nitride; and carbon powders such as carbon black and graphite. Of these, zinc oxide, aluminum oxide, cobalt oxide, manganese dioxide, strontium titanate and magnesium titanate are preferred.

In addition, lubricant powders such as the following may be added. Fluorine compounds such as Teflon®, polyvinylidene fluoride and fluorocarbons; fatty acid metal salts such as zinc stearate; fatty acids and fatty acid derivatives such as fatty acid esters; molybdenum sulfide, and amino acids and amino acid derivatives.

The toner of the invention can generally be used as either a one-component developer or a two-component developer. For example, when the inventive toner is used as a one-component developer, for magnetic toners in which a magnetic material has been included in the toner particles, the method used to transport and charge the magnetic toner may be one that employs a magnet built into the developing sleeve. Alternatively, for non-magnetic toners that do not contain a magnetic material, the method of toner transport employed may be one that entails using a blade or fur brush to forcibly triboelectrically charge the toner at the developing sleeve and thereby cause the toner to adhere to the developing sleeve. On the other hand, when the inventive toner is used in a two-component developer, a carrier is used together with the toner as the developer. The carrier is composed primarily of iron, copper, zinc, nickel, cobalt, manganese and chromium, either alone or in a mixed ferrite state. Generally, a method is used in which the above inorganic oxide is fired and granulated so as to first produce carrier core particles, which particles are then coated with the resin. Alternatively, it is possible to utilize, for example, a method in which, to lighten the load of the carrier on the toner, the inorganic oxide and the resin are kneaded and then pulverized and classified to give a low-density dispersed carrier, or a method in which a mixture of the inorganic oxide and monomer is suspension-polymerized in an aqueous medium to give a polymerization carrier.

EXAMPLES

The invention is described more fully below by way of examples, although the invention is in no way limited thereby. First, the methods used to carry out the evaluations in the examples are described below.

(1) Evaluation of Heat-Resistant Storability (Blocking Resistance)

About 10 g of toner was placed in a 100 mL plastic cup, left to stand for 7 days in a 45° C., 95% humidity environment, then visually evaluated.

(Evaluation Criteria)

A: No aggregates observed.

B: Slight aggregates observed, but these readily break up.

C: Some aggregates observed, but these readily break up.

D: Aggregates observed, but these break up with shaking.

E: Aggregates are strong enough to be grabbed, and do not readily break up.

(2) Evaluation of Low-Temperature Fixability

A two-component developer was produced by mixing together both a toner and a ferrite carrier surface-coated with a silicone resin (average particle diameter, 42 μm) so that the toner concentration became 6 mass %. Using a commercial full-color digital copier (brand name: CLC700, from Canon Inc.), an unfixed toner image (0.6 mg/cm$^2$) was formed on receiver paper (80 g/m$^2$). A fixing unit removed from a commercial full-color digital copier (brand name, CLC700, from Canon Inc.) was modified in such a way as to enable the fixing temperature to be adjusted, and this was used to carry out a fixing test on the unfixed image. The above toner image was fixed in a normal temperature, normal humidity environment by setting the process speed to 200 mm/s and varying the fixing temperature in the range of not less than 130° C. and not more than 230° C. at 5° C. intervals. The resulting fixed images were rubbed back-and-forth 5 times with lens-cleaning paper under a load of 4.9 kPa, and the temperature at which the percent decrease in concentration before and after rubbing becomes 10% or less was treated as the low temperature-side fixing onset temperature. The lower this temperature, the better the low-temperature fixability. Measurement of the image concentration was carried out by using a Macbeth RD918 reflection densitometer (from Macbeth) to measure the reflection density with respect to the printout image in a white-ground region for which the density on the original was 0.00.

(3) Evaluation of Reliability of Fixed Image (Rubbing Resistance)

The center of the leading solid image obtained at a fixing temperature of 190° C. in the test in (2) above was valley-folded, after which a load of 1 MPa was applied to that area for 10 seconds, followed by rubbing back-and-forth 5 times with lens-cleaning paper under a load of 4.9 kPa. The disrupted state of the solid image was visually confirmed, and rated according the following criteria.

(Evaluation Criteria)

A: Leading-edge solid image in folded area is free of defects.

B: Under enlarged observation with a microscope, defects are apparent in leading solid image in folded area.

C: Slight defects exist in leading solid image in folded area, but pose no practical problem.

D: Visually confirmed defects are present in leading solid image in folded area.

E: Clear defects that pose a practical problem are present in leading solid image in folded area.

(4) Evaluation of Bleedout (Percent Change in Hydrophobization on Standing in High-Temperature, High-Humidity Environment)

When wax bleedout occurs, the hydrophobicity of the toner surface increases. Hence, the degree of hydrophobicity was measured in a methanol wettability test. In the test in (1) above, methanol wettability for toner that had been left to stand for 7 days in a 45° C., 95% humidity environment and for toner that had not been left to stand was measured, and the percent change in hydrophobicity was determined using the formula shown below. A larger percent change in hydrophobicity indicates that wax bleedout has occurred in a high-temperature, high-humidity environment.

Percent change in hydrophobicity=(hydrophobicity of toner after standing)/(hydrophobicity of toner without standing)

The degree of hydrophobicity was determined as follows by a methanol wettability test. First, 60 mL of water is placed in a cylindrical glass vessel having a diameter of 5 cm and a thickness of 1.75 mm, and dispersion with an ultrasonic disperser is carried out for 5 minutes to remove air bubbles and the like within the measurement sample.

Next, the toner particles are shaken on a mesh having 150 μm openings, after which 0.1 g of the toner particles that have passed through the mesh are precisely weighed and then added to the above vessel in which water has been placed, thereby preparing a sample solution for measurement.

Next, the sample solution to be measured is set on a WET-100P powder wettability tester (Rhesca Corporation). This sample solution for measurement is stirred at a rate of 300 rpm using a magnetic stirrer. A fluoroplastic-coated spindle-type rotor having a length of 25 mm and a maximum body diameter of 8 mm is used as the rotor of the magnetic stirrer.

Next, the transparency to light having a wavelength of 780 nm is measured while continuously adding, through the above apparatus, methanol at a dropwise addition rate of 0.8 mL/min to this sample solution for measurement, and a methanol dropwise addition transparency curve is prepared. The methanol concentration at 50% transparency obtained from this curve was treated as the degree of hydrophobization.

(5) Evaluation of Change Over Time in Thermal Properties (Change in Tg on Standing in High-Temperature, High-Humidity Environment)

The extrapolated glass transition onset temperature in the DSC first temperature rise process for the toner which, in the test in (1) above, was left to stand for 7 days in a 45° C., 96% humidity environment and the extrapolated glass transition onset temperature in the DSC first temperature rise process for the toner which was not left to stand were measured, and the difference therebetween was determined.

(6) Image Durability Test after Standing in High-Temperature, High-Humidity Environment A two-component developer was prepared by mixing together the toner which, in the test in (1) above, was left to stand for 7 days in a 45° C., 95% humidity environment and a ferrite carrier surface-coated with a silicone resin (average particle diameter, 42 μm), in such a way as to set the toner concentration to 6 mass %. Using a commercial full-color digital copier (brand name, CLC700, from Canon Inc.), a 15000 page printout test in a 32.5° C., 80% humidity environment was carried out. Following completion of the 15000 page printout test, a solid image was output, the density of this solid image was measured by the same method as in (2) above, and the difference in density between the maximum density and the minimum density within the image was evaluated. When the toner incurs damage in a high-temperature, high-humidity environment, movement within the cartridge worsens, giving rise to image density non-uniformity. Ranking was carried out as shown below. The worst values in the tests are shown in the tables.

A: Density difference was less than 0.05.

B: Density difference was not less than 0.05 and less than 0.10.

C: Density difference was not less than 0.10 and less than 0.15.

D: Density difference was not less than 0.15 and less than 0.20.

E: Density difference was not less than 0.20.

Specific production examples are described below.

Wax Production Example

The thermal properties of the waxes used in the working examples of the invention and the comparative examples are shown in Table 1. These waxes were produced as described below.

Wax 1 was obtained by using a solvent method to carry out purification on slack wax obtained from crude oil. Using a mixed solvent of toluene and methyl ethyl ketone, the starting wax was dissolved at 80° C., cooled to 68° C. at a rate of 0.2° C./min and held at that temperature for 1 hour, then filtered. The filtered off wax was washed twice with fresh mixed solvent, following which the wax was removed, solvent was separated from the wax by a solvent recovery apparatus, and hydrogenation treatment was carried out. Next, using methyl isobutyl ketone as the solvent, the wax was dissolved at 80° C., cooled to 75° C. at 0.2° C./min, and to 69° C. at 0.1° C./min, and held at that latter temperature for 1 hour, then filtered. The filtered off wax was washed three times with fresh solvent, following which the wax was removed, the solvent was separated from the wax by a solvent recovery apparatus, and hydrogenation treatment was carried out, yielding Wax 1.

Wax 2 is a Fischer-Tropsch wax produced by vacuum-distilling a hydrocarbon obtained by the Fischer-Tropsch process using coal or natural gas as the starting material and then, using the same method as for Wax 1, carrying out hydrogenation treatment while changing the control temperature and the number of washes.

Wax 3 is a polyethylene wax obtained from polyethylene produced by a conventional Ziegler process as the starting material, and using the same method as for Wax 1 to carry out hydrogenation treatment while changing the control temperature and the number of washes.

Wax 4 was produced by the following procedure. A 4-neck flask equipped with a Dimroth condenser and a Dean-Stark water separator was charged with 1900 mass parts of benzene, 1400 mass parts of a carboxylic acid component, 1300 mass parts of an alcohol component and 130 mass parts of p-toluenesulfonic acid. After 6 hours of dry distillation under stirring, azeotropic distillation and removal from the water separator was carried out. The distillate was thoroughly washed with sodium bicarbonate, then dried and the benzene was driven off by distillation. The product was recrystallized from benzene and then washed and purified, thereby giving an ester wax as Wax 4.

TABLE 1

Wax types and thermal properties

| | Type of wax | Extrapolated melting onset temperature (° C.) | Melting peak temperature (° C.) | Extrapolated melting end temperature (° C.) | Endothermic peak half width (° C.) |
|---|---|---|---|---|---|
| Wax 1 | Paraffin | 67.1 | 76.2 | 78.4 | 6.3 |
| Wax 2 | Fischer-Tropsch | 74.3 | 78.1 | 80.5 | 3.1 |
| Wax 3 | Polyethylene | 62.0 | 76.5 | 82.5 | 11.5 |
| Wax 4 | Ester | 60.5 | 64.0 | 66.2 | 3.5 |

Example 1

Melting Step

The following materials were warmed to 60° C. and melt-mixed for 30 minutes.

Styrene, 70 mass parts n-Butyl acrylate, 30 mass parts

Saturated polyester resin (a polycondensate of propylene oxide-modified bisphenol A (2 mole adduct) and terephthalic acid (polymerization molar ratio, 10:12); Tg=68° C.; Mw=10000; Mw/Mn=5.12), 8 mass parts Wax 1, 19 mass parts Carbon black (BET specific surface area=80 $m^2/g$; oil absorption=120 mL/100 g), 8 mass parts E-88 (Orient Chemical Industries Co., Ltd.), 1 mass part Zinc phthalocyanine, 0.1 mass parts (Polymerizable Monomer Composition Preparation Step)

A polymerizable monomer composition was prepared by mixing the following material into the melted liquid obtained in the melting step.

Polymerization initiator: 2,2'-azobis(2,4-dimethylvaleronitrile), 10 mass parts (Granulation Step)

$Na_3PO_4.12H_2O$ (5 mass parts) was added to 332 mass parts of ion-exchanged water and the mixture was warmed to 60° C., then stirred at 3500 rpm using a Clearmix (M Technique Co., Ltd.). To this was added 27 mass parts of a 1.0 mol/L $CaCl_2$ solution in water, thereby giving a $Ca_3(PO_4)_2$-containing aqueous medium.

The above polymerizable monomer composition was poured into this aqueous medium and stirred 60° C. under $N_2$ atmosphere for 15 minutes at 4500 rpm with a Clearmix, thereby granulating the polymerization monomer composition.

(Polymerization Step)

The resulting liquid containing the granulated polymerizable monomer composition was poured into a polymerizer and, under stirring with full-zone stirring blades (Shinko Pantec Co., Ltd.), the temperature was raised to 70° C. and reaction was carried out for 10 hours.

At a stage where the polymerization ratio had risen to 95% or more, the toner dispersion was sampled, the sample was dried, and the thermal properties were measured with a DSC. The measurement results are shown in Table 2.

(Step a)

Following completion of the polymerization reaction, saturated steam (pure steam; steam pressure, 205 kPa; temperature, 120° C.) was introduced under continued stirring with the full-zone stirring blades. The temperature of the vessel contents reached 100° C., and distillate fractions began to emerge. By carrying out 240 minutes of heat treatment at 100° C. until a given amount of distillate was obtained, Step (a) heat treatment was carried out while driving off residual monomer.

(Step b)

Following completion of Step (a), cooling from 100° C. was carried out at a rate of 0.5° C./min. When the temperature reached 64.0° C., 180 minutes of heat treatment (Step b) was carried out while controlling the temperature fluctuation range, centered on 64.0° C., to 2.0° C. Cooling at a rate of 0.25° C./min to 30° C. was then carried out.

(Washing, Solid-Liquid Separation and Drying Step)

Hydrochloric acid was added to the resulting toner particle dispersion and stirring was carried out, thereby dissolving the $Ca_3(PO_4)_2$ covering the toner particles, following which solid-liquid separation was carried out with a pressure filter, thereby giving a toner cake. This was placed in water and stirred, once again rendering it into a dispersion, following which solid-liquid separation was carried out with the above filter. After repeatedly carrying out re-dispersion of the toner cake in water and solid-liquid separation until the $Ca_3(PO_4)_2$ was sufficiently removed, final solid-liquid separation was carried out, giving a toner cake. The resulting toner cake was dried with an airborne drier (Flash Jet Drier, from Seishin Enterprise Co., Ltd.), giving the toner particles. The drying conditions were set to a blowing temperature of 90° C. and a dryer outlet temperature of 40° C., and the toner cake feed rate was adjusted, according to the toner cake water content, to a rate such that the outlet temperature does not depart from 40° C.

(External Addition Step)

In this step, 2.5 mass parts of dry silica (BET specific surface area, 120 $m^2/g$) having a primary particle diameter of 12 nm and treated with silicone oil and hexamethylsilazane was externally added to 100 mass parts of the resulting toner particles, thereby giving Toner 1 having a weight-average particle diameter of 6.1 μm.

(Evaluation)

The results of thermal property measurements on the resulting toners are shown in Table 3, and the results of evaluations carried out in accordance with the above-described evaluation methods are shown in Table 4.

Example 2 to Example 4

Aside from changing the wax added in the Melting Step and the temperature in Step (b) as shown in Table 2, toners were produced by the same method as in Example 1. The results of thermal property measurements are shown in Table 3, and the evaluation results are shown in Table 4.

Example 5 to Example 10

Aside from controlling the temperature fluctuation range and the heat treatment time in Step (b) as shown in Table 2, toners were produced by the same method as in Example 1. The results of thermal property measurements are shown in Table 3, and the evaluation results are shown in Table 4.

Example 11 and Example 12

Aside from controlling the heat treatment temperature and the heat treatment time in Step (a) as shown in Table 2, toners were produced by the same method as in Example 1. The results of thermal property measurements are shown in Table 3, and the evaluation results are shown in Table 4.

Example 13 and Example 14

Aside from controlling the heat treatment temperature in Step (b) as shown in Table 2, toners were produced by the same method as in Example 1. The results of thermal property measurements are shown in Table 3, and the evaluation results are shown in Table 4.

Comparative Example 1

Aside from changing the wax added in the Melting Step and the temperature in Step (b) as shown in Table 2, a toner was produced by the same method as in Example 1. The results of thermal property measurements are shown in Table 3, and the evaluation results are shown in Table 4. Because an ester wax (ester-based wax) is used in Comparative Example 1 and a hydrocarbon wax is not included, the production conditions that should be determined based on the thermal properties of a hydrocarbon wax were instead determined after measuring the thermal properties of Wax 4, which is an ester wax.

Comparative Example 2 and Comparative Example 3

Aside from changing the wax added in the Melting Step as shown in Table 2 and carrying out cooling without carrying out the heat treatment in Step (b), a toner was produced by the same method as in Example 1. The results of thermal property measurements are shown in Table 3, and the evaluation results are shown in Table 4.

Comparative Example 4

The temperature in the Melting Step was set to 90° C., and this step was carried out for 240 minutes as Step (a); Step (a) following the Polymerization Step was not carried out. Aside from this, a toner was produced by the same method as in Example 1. The results of thermal property measurements are shown in Table 3, and the evaluation results are shown in Table 4.

Comparative Example 5 and Comparative Example 6

Aside from controlling the heat treatment temperature and the heat treatment time in Step (a) as shown in Table 2, toners were produced by the same method as in Example 1. The results of thermal property measurements are shown in Table 3, and the evaluation results are shown in Table 4.

Comparative Example 7 to Comparative Example 10

Aside from controlling the heat treatment temperature, temperature fluctuation range and heat treatment time in Step (b) as shown in Table 2, toners were produced by the same method as in Example 1. The results of thermal property measurements are shown in Table 3, and the evaluation results are shown in Table 4.

Comparative Example 11

Instead of carrying out heat treatment in Step (b), gradual cooling was carried out. The gradual cooling conditions were as follows: following completion of Step (a), cooling was carried out from 100° C. to 70° C. at 0.5° C./min, from 70° C. to 50° C. at 0.1° C./min, and from 50° C. to 30° C. at 0.25° C./min. Aside from this, toners were produced by the same method as in Example 1. The results of thermal property measurements are shown in Table 3, and the evaluation results are shown in Table 4.

TABLE 2

Thermal Properties of Wax in Toner Before Carrying Out Heat Treatment, and Heat Treatment Step Conditions

| | Wax added in Melting Step | | Thermal properties of wax in toner after polymerization reaction | | | | Step (a) production conditions | | Step (b) production conditions | | |
|---|---|---|---|---|---|---|---|---|---|---|---|
| | Type | Amount added (parts) | Extrapolated melting onset temperature (° C.) | Extrapolated melting end temperature (° C.) | Low-temperature side rise in crystallization exothermic peak (° C.) | High-temperature side rise in crystallization exothermic peak (° C.) | Heat treatment temperature (° C.) | Heat treatment time (min) | Heat treatment temperature (° C.) | Temperature fluctuation range (° C.) | Heat treatment time (min) |
| Example 1 | Wax 1 | 9 | 68.2 | 79.5 | 60.5 | 76.1 | 100.0 | 240 | 64.0 | 2.0 | 180 |
| Example 2 | Wax 2 | 9 | 76.1 | 83.2 | 69.5 | 80.4 | 100.0 | 240 | 73.0 | 2.0 | 180 |
| Example 3 | Wax 3 | 9 | 64.4 | 84.1 | 51.8 | 80.7 | 100.0 | 240 | 55.0 | 2.0 | 180 |
| Example 4 | Wax 1, Wax 4 | 9 3 | 64.3 | 78.1 | 52.1 | 74.9 | 100.0 | 240 | 55.0 | 2.0 | 180 |
| Example 5 | Wax 1 | 9 | 68.2 | 79.5 | 60.5 | 76.1 | 100.0 | 240 | 64.0 | 0.2 | 180 |
| Example 6 | Wax 1 | 9 | 68.2 | 79.5 | 60.5 | 76.1 | 100.0 | 240 | 64.0 | 4.0 | 180 |
| Example 7 | Wax 1 | 9 | 68.2 | 79.5 | 60.5 | 76.1 | 100.0 | 240 | 64.0 | 2.0 | 360 |
| Example 8 | Wax 1 | 9 | 68.2 | 79.5 | 60.5 | 76.1 | 100.0 | 240 | 64.0 | 2.0 | 90 |
| Example 9 | Wax 1 | 9 | 68.2 | 79.5 | 60.5 | 76.1 | 100.0 | 240 | 64.0 | 2.0 | 640 |
| Example 10 | Wax 1 | 9 | 68.2 | 79.5 | 60.5 | 76.1 | 100.0 | 240 | 64.0 | 2.0 | 60 |
| Example 11 | Wax 1 | 9 | 68.2 | 79.5 | 60.5 | 76.1 | 89.5 | 240 | 64.0 | 2.0 | 180 |
| Example 12 | Wax 1 | 9 | 68.2 | 79.5 | 60.5 | 76.1 | 100.0 | 60 | 64.0 | 2.0 | 180 |
| Example 13 | Wax 1 | 9 | 68.2 | 79.5 | 60.5 | 76.1 | 100.0 | 240 | 60.0 | 2.0 | 180 |
| Example 14 | Wax 1 | 9 | 68.2 | 79.5 | 60.5 | 76.1 | 100.0 | 240 | 68.0 | 2.0 | 180 |
| Comparative Example 1 | Wax 4 | 9 | 63.0 | 68.7 | 50.3 | 66.6 | 100.0 | 240 | 55.0 | 2.0 | 180 |
| Comparative Example 2 | Wax 2 | 9 | 76.1 | 83.2 | 69.5 | 80.4 | none | none | none | none | none |
| Comparative Example 3 | Wax 3 | 9 | 64.4 | 84.1 | 51.8 | 80.7 | none | none | none | none | none |
| Comparative Example 4 | Wax 1 | 9 | 68.2 | 79.5 | 60.5 | 76.1 | 90.0° C., 240 minutes in Melting Step | | 64.0 | 2.0 | 180 |
| Comparative Example 5 | Wax 1 | 9 | 68.2 | 79.5 | 60.5 | 76.1 | 88.5 | 240 | 64.0 | 2.0 | 180 |
| Comparative Example 6 | Wax 1 | 9 | 68.2 | 79.5 | 60.5 | 76.1 | 100.0 | 50 | 64.0 | 2.0 | 180 |
| Comparative Example 7 | Wax 1 | 9 | 68.2 | 79.5 | 60.5 | 76.1 | 100.0 | 240 | 60.0 | 2.0 | 180 |
| Comparative Example 8 | Wax 1 | 9 | 68.2 | 79.5 | 60.5 | 76.1 | 100.0 | 240 | 68.5 | 2.0 | 180 |
| Comparative Example 9 | Wax 1 | 9 | 68.2 | 79.5 | 60.5 | 76.1 | 100.0 | 240 | 64.0 | 5.0 | 180 |
| Comparative Example 10 | Wax 1 | 9 | 68.2 | 79.5 | 60.5 | 76.1 | 100.0 | 240 | 64.0 | 2.0 | 50 |
| Comparative Example 11 | Wax 1 | 9 | 68.2 | 79.5 | 60.5 | 76.1 | 100.0 | 240 | gradual cooling from 70.0° C. to 50.0° C. | | |

TABLE 3

Results of thermal property measurements on toner obtained

| | Wax melting peak half width | | | Heat absorption amount for wax melting peak | | | Extrapolated glass transition onset temperature for toner | | |
|---|---|---|---|---|---|---|---|---|---|
| | W1 (° C.) | W2 (° C.) | W1/W2 | Q1 (J/g) | Q2 (J/g) | Q1/Q2 | Tg1 (° C.) | Tg2 (° C.) | Tg1 − Tg2 |
| Example 1 | 4.9 | 7.0 | 0.70 | 11.3 | 9.0 | 1.3 | 61.0 | 49.0 | 12.0 |
| Example 2 | 2.6 | 3.7 | 0.70 | 11.3 | 9.0 | 1.3 | 61.0 | 49.0 | 12.0 |
| Example 3 | 9.3 | 13.2 | 0.70 | 11.3 | 9.0 | 1.3 | 61.0 | 49.0 | 12.0 |
| Example 4 | 5.7 | 8.1 | 0.70 | 10.5 | 8.3 | 1.3 | 55.0 | 43.0 | 12.0 |
| Example 5 | 3.5 | 7.0 | 0.50 | 11.3 | 9.0 | 1.3 | 61.0 | 49.0 | 12.0 |
| Example 6 | 6.3 | 7.0 | 0.90 | 11.3 | 9.0 | 1.3 | 61.0 | 49.0 | 12.0 |
| Example 7 | 4.2 | 7.0 | 0.60 | 13.5 | 9.0 | 1.5 | 64.0 | 49.0 | 15.0 |
| Example 8 | 5.6 | 7.0 | 0.80 | 10.0 | 9.0 | 1.1 | 54.0 | 49.0 | 5.0 |
| Example 9 | 4.2 | 7.0 | 0.60 | 14.0 | 9.0 | 1.6 | 65.0 | 49.0 | 16.0 |
| Example 10 | 6.3 | 7.0 | 0.90 | 9.4 | 9.0 | 1.0 | 53.0 | 49.0 | 4.0 |
| Example 11 | 6.0 | 6.7 | 0.90 | 12.5 | 9.8 | 1.3 | 63.0 | 51.0 | 12.0 |
| Example 12 | 6.0 | 6.7 | 0.90 | 12.5 | 9.8 | 1.3 | 63.0 | 51.0 | 12.0 |
| Example 13 | 6.3 | 7.0 | 0.90 | 10.0 | 9.0 | 1.1 | 55.0 | 49.0 | 6.0 |
| Example 14 | 6.3 | 7.0 | 0.90 | 10.0 | 9.0 | 1.1 | 55.0 | 49.0 | 6.0 |
| Comparative Example 1 | 4.1 | 3.6 | 1.14 | 8.9 | 4.3 | 2.1 | 52.0 | 40.0 | 12.0 |
| Comparative Example 2 | 3.1 | 3.1 | 1.00 | 9.6 | 9.2 | 1.0 | 51.0 | 51.0 | 0.0 |
| Comparative Example 3 | 11.5 | 11.5 | 1.00 | 9.6 | 9.2 | 1.0 | 51.0 | 51.0 | 0.0 |
| Comparative Example 4 | 6.0 | 6.3 | 0.95 | 12.5 | 9.8 | 1.3 | 63.0 | 53.0 | 10.0 |
| Comparative Example 5 | 6.1 | 6.4 | 0.95 | 11.3 | 10.3 | 1.1 | 58.0 | 51.0 | 7.0 |
| Comparative Example 6 | 6.1 | 6.4 | 0.95 | 11.3 | 10.3 | 1.1 | 58.0 | 51.0 | 7.0 |
| Comparative Example 7 | 6.8 | 6.8 | 1.00 | 9.4 | 9.0 | 1.0 | 53.0 | 49.0 | 4.0 |
| Comparative Example 8 | 7.3 | 7.3 | 1.00 | 9.0 | 9.0 | 1.0 | 50.0 | 49.0 | 1.0 |
| Comparative Example 9 | 6.7 | 7.0 | 0.96 | 11.3 | 9.0 | 1.3 | 61.0 | 49.0 | 12.0 |
| Comparative Example 10 | 6.7 | 7.0 | 0.96 | 9.0 | 9.0 | 1.0 | 53.0 | 49.0 | 4.0 |
| Comparative Example 11 | 7.0 | 7.0 | 1.00 | 10.5 | 9.0 | 1.2 | 60.0 | 49.0 | 11.0 |

TABLE 4

Evaluation results for toner

| | Heat-resistant storability | Low-temperature fixability (° C.) | Fixed image reliability | Breedout (percent change in degree of hydrophobicity) | Change over time in thermal properties (° C.) | Deterioration over time in developability |
|---|---|---|---|---|---|---|
| Example 1 | B | 150 | A | 1.3 | 0.8 | B(0.08) |
| Example 2 | A | 150 | C | 1.3 | 0.8 | B(0.08) |
| Example 3 | C | 150 | A | 1.3 | 0.8 | B(0.08) |
| Example 4 | B | 140 | A | 1.5 | 1.0 | C(0.12) |
| Example 5 | A | 150 | A | 1.1 | 0.2 | A(0.03) |
| Example 6 | C | 150 | A | 1.6 | 0.8 | B(0.08) |
| Example 7 | B | 150 | A | 1.1 | 0.2 | A(0.03) |
| Example 8 | C | 150 | A | 1.5 | 1.0 | C(0.12) |
| Example 9 | B | 150 | A | 1.0 | 0.0 | A(0.03) |
| Example 10 | C | 150 | A | 1.6 | 0.8 | B(0.08) |
| Example 11 | B | 160 | B | 1.4 | 1.0 | B(0.08) |
| Example 12 | B | 160 | B | 1.4 | 1.0 | B(0.08) |
| Example 13 | C | 150 | A | 1.6 | 1.0 | C(0.12) |
| Example 14 | C | 150 | A | 1.6 | 1.0 | C(0.12) |
| Comparative Example 1 | A | 140 | D | 1.4 | 1.3 | D(0.18) |
| Comparative Example 2 | B | 150 | E | 1.8 | 3.0 | E(0.25) |
| Comparative Example 3 | D | 150 | B | 1.8 | 3.0 | E(0.25) |
| Comparative Example 4 | C | 170 | E | 1.6 | 1.5 | D(0.18) |
| Comparative Example 5 | C | 160 | D | 1.6 | 2.0 | D(0.18) |
| Comparative Example 6 | C | 160 | D | 1.6 | 2.0 | D(0.18) |
| Comparative Example 7 | D | 150 | D | 2.0 | 2.0 | E(0.25) |
| Comparative Example 8 | E | 150 | C | 2.2 | 2.2 | E(0.25) |

TABLE 4-continued

| Evaluation results for toner | | | | | | |
|---|---|---|---|---|---|---|
| | Heat-resistant storability | Low-temperature fixability (° C.) | Fixed image reliability | Breedout (percent change in degree of hydrophobicity) | Change over time in thermal properties (° C.) | Deterioration over time in developability |
| Comparative Example 9 | D | 150 | D | 1.8 | 2.0 | E(0.25) |
| Comparative Example 10 | D | 150 | D | 2.2 | 2.2 | E(0.25) |
| Comparative Example 11 | C | 150 | D | 2.0 | 2.0 | E(0.25) |

As is apparent from Table 4, compared with the toners in Comparative Examples 1 to 11, the toners in Examples 1 to 14 according to the invention achieved a good balance of low-temperature fixability and heat-resistant storability, and also provided excellent fixed image reliability. Also, the toners obtained by the toner production method of this invention achieved a good balance of low-temperature fixability and heat-resistant storability, and also provided excellent fixed image reliability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-135170, filed Jun. 27, 2013, European Patent Application No. 14171069.9, filed Jun. 4, 2014, and Japanese Patent Application No. 2014-126156, filed Jun. 19, 2014, which are hereby incorporated by reference herein in its entirety.

What is claimed is:

1. A toner comprising a binder resin, a colorant and a hydrocarbon wax, wherein the toner has a ratio W1/W2 of not less than 0.50 and not more than 0.90, where:

W1 (° C.) is the half width of an endothermic peak derived from melting of the hydrocarbon wax in a first temperature rise process on the toner, and W2 (° C.) is the half width of an endothermic peak derived from melting of the hydrocarbon wax in a second temperature rise process on the toner, W1 and W2 being measured with a differential scanning calorimeter.

2. The toner according to claim 1, wherein the ratio Q1/Q2 is not less than 1.1 and not more than 1.5, where:

Q1 (J/g) is the amount of heat absorption of the endothermic peak in the first temperature rise process, and Q2 (J/g) is the amount of heat absorption of the endothermic peak in the second temperature rise; and the difference Tg1—Tg2 is not less than 5.0° C. and not more than 15.0° C., where:

Tg1 (° C.) is an extrapolated glass transition onset temperature in the first temperature rise process on the toner, and Tg2 (° C.) is an extrapolated glass transition onset temperature in the second temperature rise process on the toner, Tg1 and Tg2 (° C.) being measured with the differential scanning calorimeter.

3. The toner according to claim 1, wherein, when the hydrocarbon wax alone is measured with a differential scanning calorimeter, the endothermic peak derived from melting of the hydrocarbon wax has a half width of not less than 2.0° C. and not more than 12.0° C.

4. The toner according to claim 1, wherein, when the hydrocarbon wax alone is measured with a differential scanning calorimeter, the endothermic peak derived from melting of the hydrocarbon wax has a peak temperature of not less than 60° C. and not more than 90° C.

5. The toner according to claim 1, wherein the binder resin is a styrene-acrylate copolymer or a styrene-methacrylate copolymer.

6. The toner according to claim 1, wherein the hydrocarbon wax content is not more than 20 mass parts per 100 mass parts of the binder resin.

7. A method of producing the toner according to claim 1, with the toner having a binder resin, a colorant and a hydrocarbon wax, the method comprising: heat-treating the toner under following conditions of a step (a) and a step (b), with the step (a) being implemented before the step (b), (Step (a)) heat-treating the toner for not less than 60 minutes at a temperature not less than 10° C. higher than the extrapolated melting end temperature of the hydrocarbon wax, as measured with a differential scanning calorimeter in the presence of the binder resin and the hydrocarbon wax; and (Step (b)) heat-treating the toner for not less than 60 minutes at a temperature within the temperature range of the exothermic peak derived from crystallization of the hydrocarbon wax as measured with a differential scanning calorimeter, with a temperature fluctuation range that is centered on a temperature below the extrapolated melting onset temperature of the hydrocarbon wax being not more than 4.0° C.

8. The toner production method according to claim 7, wherein, when the hydrocarbon wax alone is measured with a differential scanning calorimeter, the endothermic peak derived from melting of the hydrocarbon wax has a half width of not less than 2.0° C. and not more than 12.0° C.

9. The toner production method according to claim 7, wherein, when the hydrocarbon wax alone is measured with a differential scanning calorimeter, the endothermic peak derived from melting of the hydrocarbon wax has a peak temperature of not less than 60° C. and not more than 90° C.

10. The toner production method according to claim 7, wherein the binder resin is a styrene-acrylate copolymer or a styrene-methacrylate copolymer.

11. The toner production method according to claim 7, wherein the content of the hydrocarbon wax is not more than 20 mass parts per 100 mass parts of the binder resin.

12. A toner comprising a binder resin, a colorant and a hydrocarbon wax, wherein the toner has a ratio W1/W2 of not less than 0.50 and not more than 0.90, where:

W1 (° C.) is the half width of an endothermic peak derived from melting of the hydrocarbon wax in a first temperature rise process of the toner, and W2 (° C.) is the half width of an endothermic peak derived from melting of the hydrocarbon wax in a second temperature rise process on the toner, W1 and W2 being measured with a differential scanning calorimeter, and W2 ranging of not less than 3.7° C. and not more than 13.2° C.

13. The toner according to claim 12, wherein, when the hydrocarbon wax is alone is measured with a differential scanning calorimeter, the endothermic peak derived from melting of the hydrocarbon has a half width of not less than 2.0° C. and not more than 12.0° C.

* * * * *